United States Patent [19]

Singou et al.

[11] Patent Number: 4,989,772

[45] Date of Patent: Feb. 5, 1991

[54] AUTOMATIC FILE FEED REGISTER DEVICE

[75] Inventors: Hiromichi Singou, Yokohama; Yukio Sasayama, Tokyo, both of Japan

[73] Assignee: Toyo Shokuhin Kikai Kabushiki Kaisha, Yokohama, Japan

[21] Appl. No.: 488,426

[22] Filed: Feb. 27, 1990

Related U.S. Application Data

[63] Continuation of Ser. No. 253,123, Oct. 4, 1988, abandoned.

[51] Int. Cl.[5] ..... B65H 17/22

[52] U.S. Cl. ..... 226/139

[58] Field of Search ..... 226/139, 141, 142, 152, 226/156, 157

[56] References Cited

U.S. PATENT DOCUMENTS

| | | | |
|---|---|---|---|
| 4,008,839 | 2/1977 | Yamashita | 226/142 X |
| 4,285,453 | 8/1981 | Flamme et al. | 226/152 X |
| 4,545,518 | 10/1985 | Bergland | 226/139 |
| 4,601,420 | 7/1986 | Kato | 226/142 X |
| 4,723,488 | 2/1988 | Inouye et al. | 226/143 X |
| 4,751,879 | 6/1988 | Van Pelt | 226/143 X |
| 4,781,317 | 11/1988 | Ditto | 226/29 X |

*Primary Examiner*—Daniel P. Stodola
*Assistant Examiner*—Paul Thomas Bowen
*Attorney, Agent, or Firm*—David O'Reilly

[57] ABSTRACT

This invention relates to an automatic film feed register device for feeding film to a bag manufacturing device, in which setting of the film intermittent feeding pitch can be done by a keyboard of a microcomputer by an unskilled worker not withstanding whether the machine is operating or stopped. The machine has intermittent feed rollers for a film, a crank connected to the feed rollers through an electromagnetic brake and an electromagnetic clutch, a device shaft for said crank, and an adjusting device for adjusting the eccentric distance of the crank, characterized by an adding mechanism provided between the drive shaft and the adjusting device for adjusting the eccentric distance of the crank. The motion of a drive shaft is controlled by a microcomputer input into the adding mechanism.

1 Claim, 8 Drawing Sheets

AUTOMATIC FILE FEED REGISTER DEVICE

This is a continuation of co-pending application Ser. No. 07/253,123 filed on Oct. 4. 1988.

FIELD OF THE INVENTION

This invention relates to an automatic film feed register device for feeding film to a bag manufacturing device such as disclosed in Japanese Patent Application No. 60-29164 in which the film is fed intermittently.

BACKGROUND OF THE INVENTION

Heretofore, in bag manufacturing devices, the film is fed intermittently and sealed by sealer to make a bag.

FIG. 2 shows a front view of a prior art device comprised of a film supplying part 1, film driving part 2, and bag pick up part 3.

In film supplying part 1, film 4 is taken from film roll 10, folded along the center line by folding device 11, and fed intermittently through dancer or damper roll section 12.

Film driving part 2 comprises a pair of intermittent feed rollers 20, 21. As shown in FIG. 4, lower feed roll 21 is connected to crank 36 through shaft 22, pulley 23, timing belt 24, pulley 25, output shaft 26, electromagnetic brake 27, electromagnetic clutch 28, pinion shaft 29, pinion 30, spur gear 31, pinion 32, sector gear 33, pin 34, and connecting rod 35.

In crank 36, arm 38 of U-shaped cross section is fixed to drive shaft 37 of a motor (not shown). Screw 39 is supported in arm 38, and nut block 40 is mounted on screw 39 so as to move along its axis upon rotation of screw 39. Connecting rod 35 is connected to nut block 40 through pin 41.

As shown in FIG. 2, sealer 42 and sealing roller 43 are provided at the front of feed rollers 20, 21, shown in FIG. 1. Sealing cams 44, 44 are fixed on drive shaft 37 for actuating sealer 42 up and down.

Bag pick up part 3 is substantially the same as that of Japanese Patent Application 60-29164 which is not an essential part of this invention so a detailed explanation of this part is not included.

The operation of the device is as follows:

As shown in FIG. 4, upon rotation of drive shaft 37, arm 38 rotates, pinion shaft 29 rotates through operation of connecting rod 35, sector gear 33, pinion 32, spur gear 31, and pinion 30. When pinion shaft 29 rotates in a counter clockwise direction, clutch 28 is connected and brake 27 is inactive. In contrast, when pinion shaft 29 rotates in a reverse direction, clutch 28 is inactive and brake 27 is active. Therefore, feed rollers 20, 21 rotate intermittently. Clutch 28 and brake 27 are controlled at high speed for accurate film feed pitch, being active and inactive repeatedly at high speed.

Sealer 42 is moved up and down by sealing cam 44, 44 attached to drive shaft 37, as shown in FIG. 1, in syncronization with intermittent feed of film 4 by feed rollers 20, 21, and seals and cuts film 4 when it is stopped, to produce a bag 4*a*.

In the case of unprinted film, upper dead point ($\theta=180$ degrees in FIG. 4) and lower dead point ($\theta=0$ degrees in FIG. 4) of crank 36 and rod 35 are detected by timing cam (not shown) and a limit switch or contactless switch etc., and the detecting signal is fed to clutch 28 and brake 27 to operate them. Alternatively, an encoder is fixed on shaft 37 which may generate similar signals. The feed pitch of film 4 is determined by the eccentric distance of crank 36.

In the case of printed film, as shown in FIG. 2, photoelectric detector 45 is supported above the running face of film 4 for detecting a printed pattern or special eye or registration mark for detecting the film feed pitch. The detecting range of the detector is limited by a timing cam or decoder to avoid error due to another print or dirt. The detected signal "t" of detector 45 is fed to clutch 28 and brake 27 through high speed control unit 46, so as to seal and cut film 4 in registration with the printed pattern or eye mark. The eccentric distance of the crank is set to feed the film by a distance which is a little in excess of distance "d" larger than the pitch of the print for assuring passage of eye mark under detector 45. By this setting, the eye mark is sure to pass under detector 45. Detector 45 detects the eye mark and sends a signal "t" for disconnecting clutch 28 and operating brake 27. For this reason, detector 45 operates a little prior or beyond the lower dead point of crank 36.

Thus, the light spot on the head of detector 45 detects a printed mark or eye mark and stops the feed of film 4, and accuracy of the width of bag 4*a* is improved.

However, the accuracy of printed marks is not good, and their pitch varies. Moreover, the pitch of the mark varies according to the stretching of film 4 during manufacturing. Recently the tendency has increased according to a larger diameter of the film roll. If the pitch of the mark increases, the mark does not come into the detecting range of detector 45, (i.e. the spot of light or head due to the lack of the feed of the film), so that control of the detector fails and makes many defective bags before an operator discovers it. Otherwise, if the pitch becomes shorter, distance "d" becomes larger, the actuating point of brake 27 is offset from the lower dead point of crank 36, and a rapid stop during the rotation of output shaft 26, clutch 28, brake 27, feed rollers 20, 21, sealing roller 43 is repeated which wears on clutch 28 and brake 27, and shortens their life. It also increases the noise of the machine, accuracy of the width of a bag 4*a* becomes bad, and lowering the quality of the bags.

To prevent these drawbacks, an operator inspects the operation and can not do any other work. When the pitch of the mark becomes shorter, the excess distance "d" should be adjusted, but the amount of the excess distance "d" is not clear and setting it to a larger amount might cause the former drawback to occur.

To set the excess distance "d", as shown in FIG. 3*b*, crank 36 should be rotated to a position where a special handle can be inserted into screw 39 of crank 36, then the handle is rotated while watching the position of crank 36. Then, by rotating crank 36, one of friction blocks 14 and 15 provided on a special fine adjusting handle 13 engages toothed gear 16 provided at the end of screw 39 and rotates gear 16 and screw 39 in a clockwise or counter-clockwise direction. This moves nut block 40 and pin 41 and the eccentric distance of the crank can be adjusted. The adjustment is repeated until the feed pitch reaches the right value. On the other hand, film 4 is set to be fed a somewhat longer pitch than the pitch of the mark under an inactive state of detector 45. Then the head of detector 45 is put on the passing line of the mark and actuates detector 45 for controlling clutch 28 and brake 27.

However, the above mentioned adjusting operation is hard for unskilled workers and a great loss of bags occur.

BRIEF DESCRIPTION OF THE INVENTION

This invention is intended to eliminate these drawbacks, and one object of this invention is to provide an automatic film feed register device in which the adjustment of the film intermittent feeding pitch, i.e. width of the bag, can be done during operation or stopping of the machine by means of a driving device controlled by a microcomputer, so that optimum feeding of film is achieved according to the printing pitch.

Another object of this invention is to provide an automatic film feed register device in which setting of the film intermittent feeding pitch can be done on a key board of a microcomputer by an unskilled worker not withstanding whether the machine is operating or stopped.

Another object of this invention is to provide an automatic film feed register device in which testing or loss of film is not necessary for adjustment.

Another object of this invention is to provide an automatic film feed register device in which a microcomputer adjusts the excess distance "d" to be constant even if the pitch of a mark varies, so that a mark is never offset from the detecting range, (i.e. light spot), so that a detector can control the machine accurately and operator can do other work.

Still another object of this invention is to provide an automatic film feed register device in which the excess distance "d" can be adjusted to a minimum value and an electromagnetic clutch, and electromagnetic brake can be operated at a lower dead point of a crank. This lengthens the life of parts, such as the electromagnetic clutch, electromagnetic brake, etc., and minimizes the noise from vibration of the machine, and increases the accuracy and quality of bags.

The first invention comprises intermittent feed rollers 20, 21 for film 4, a crank 36 connected to feed rollers 20, 21 through electromagnetic brake 27, and electromagnetic clutch 28. Also-included are drive shaft 37 for crank 36, and adjustable means 39 for adjusting the eccentric distance of crank 36 characterized by an adding mechanism 48 provided between drive shaft 37 and adjustable means 39 for adjusting the eccentric distance of crank 36. The motion of drive 49 is controlled by micro-computer 80 providing input to adding mechanism 48.

In the second invention, film driving part 2 comprises intermittent feed rollers 20, 21 for film 4, and a crank 36 connected to feed rollers 20, 21 through electromagnetic brake 27 and electromagnetic clutch 28. Also included are drive shaft 37 for crank 36, adjustable means 39 for adjusting the eccentric distance of crank 36, a photo-electric detector 45 for detecting a printed mark on film 4, a high speed control unit 46 for controlling electromagnetic brake 27 and electromagnetic clutch 28 at high speed by detected signal "t", characterized by an adding mechanism 48 provided between drive shaft 37 and adjustable means 39 for adjusting the eccentric distance of crank 36. The motion of drive 49 is controlled by microcomputer 80 providing input into adding mechanism 48. Signal "b" of encoder 82 for detecting intermittent feeding distance of feed rollers 20, 21 and signal "s" for setting the excess distance "d" of said film feed distance are also input into microcomputer 80.

Adding mechanism means 48 is a mechanism for adding mechanical motion such as an epicyclic gear, planetary gear, sun and planet gear, or a differential gear.

The above and other objects, advantages and novel features of this invention will be more fully understood from the following detailed description and the accompanying drawings, in which like reference numbers indicate like or similar parts throughout wherein.

DETAILED DESCRIPTION OF THE INVENTION

Figure 1:
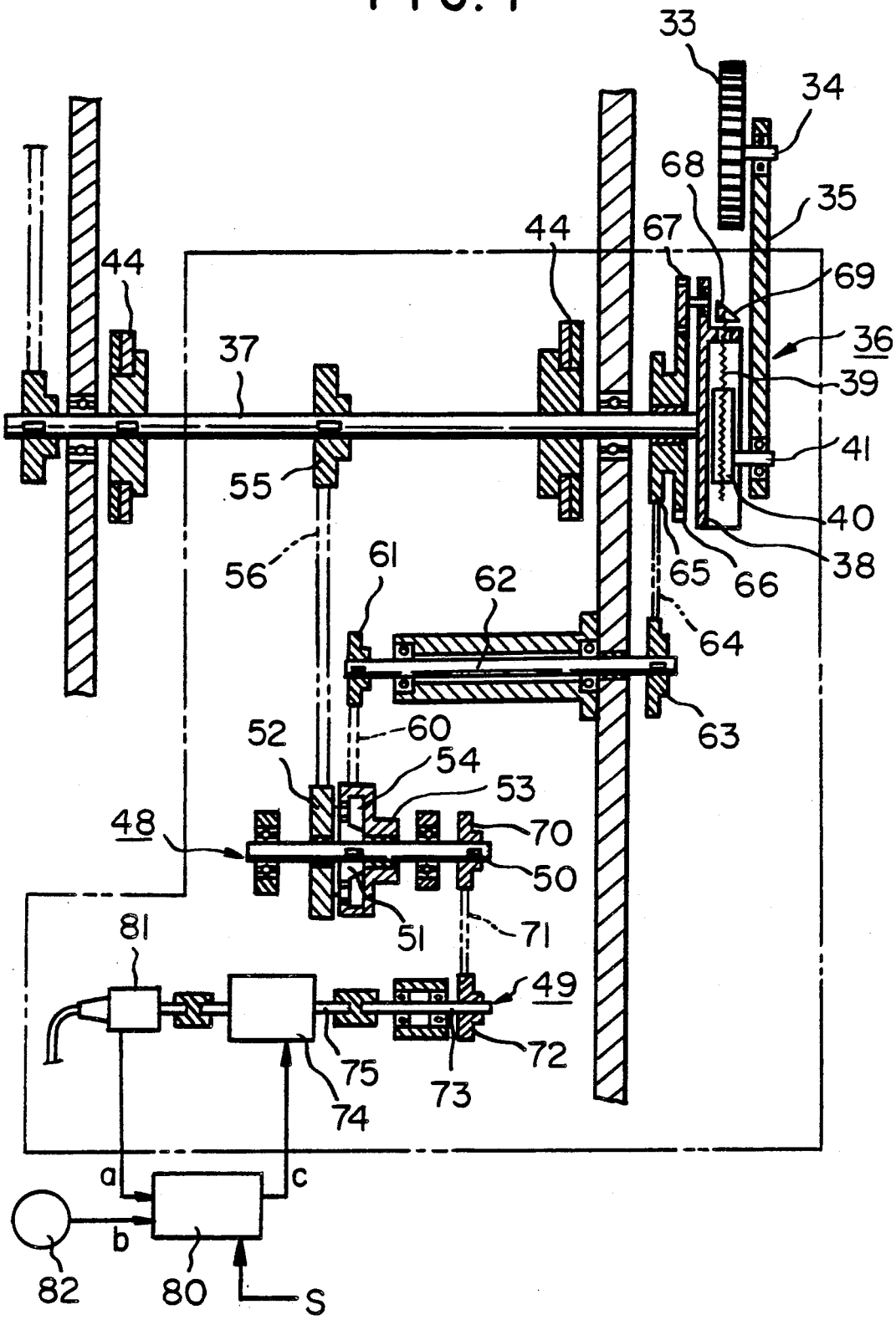
FIG. 1 is a cross-sectional view of one embodiment of this invention.
Figure 2:
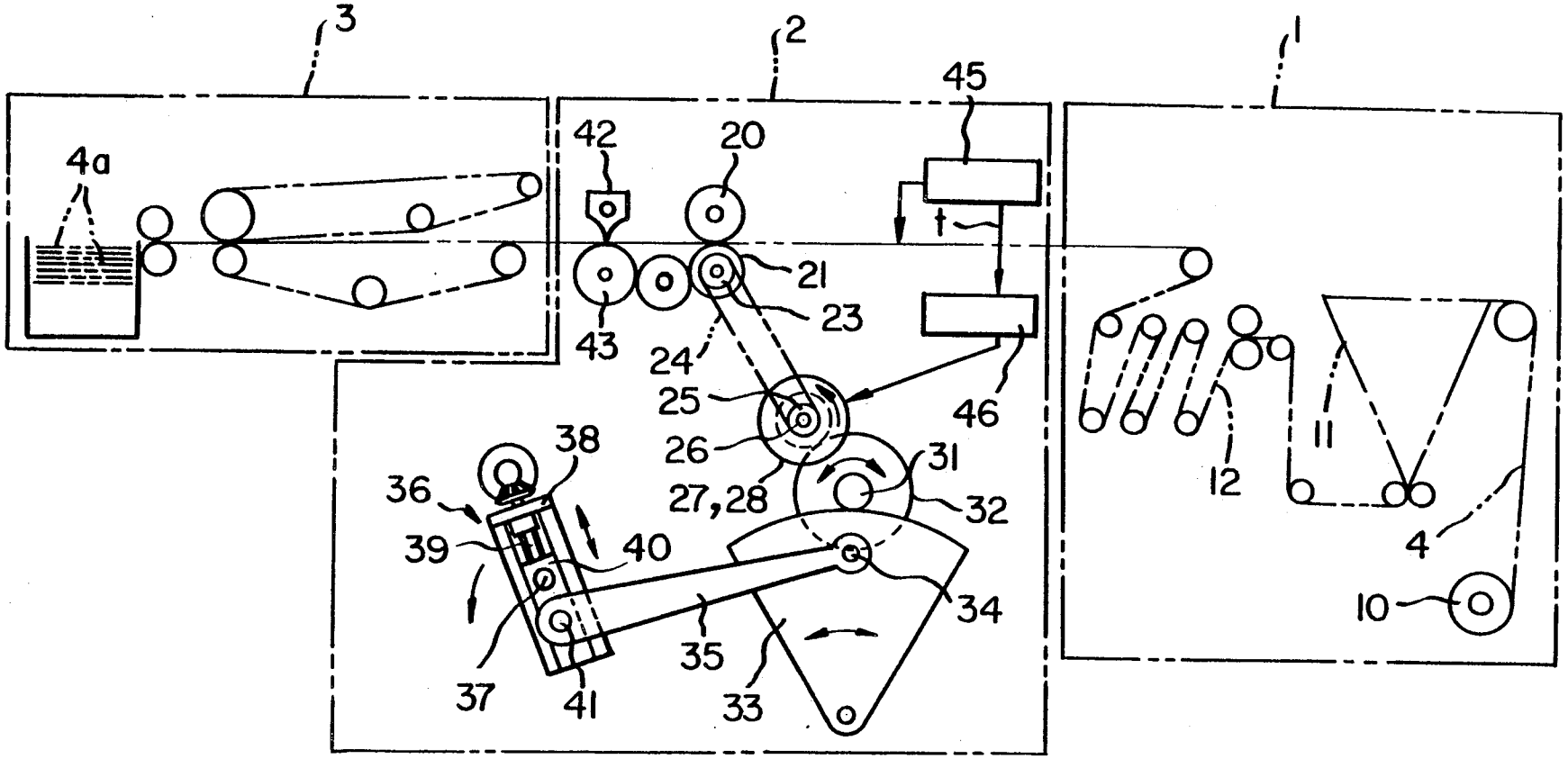
FIG. 2 (PRIOR ART)
FIG. 2 is a front view of a prior art device.
Figure 3A:
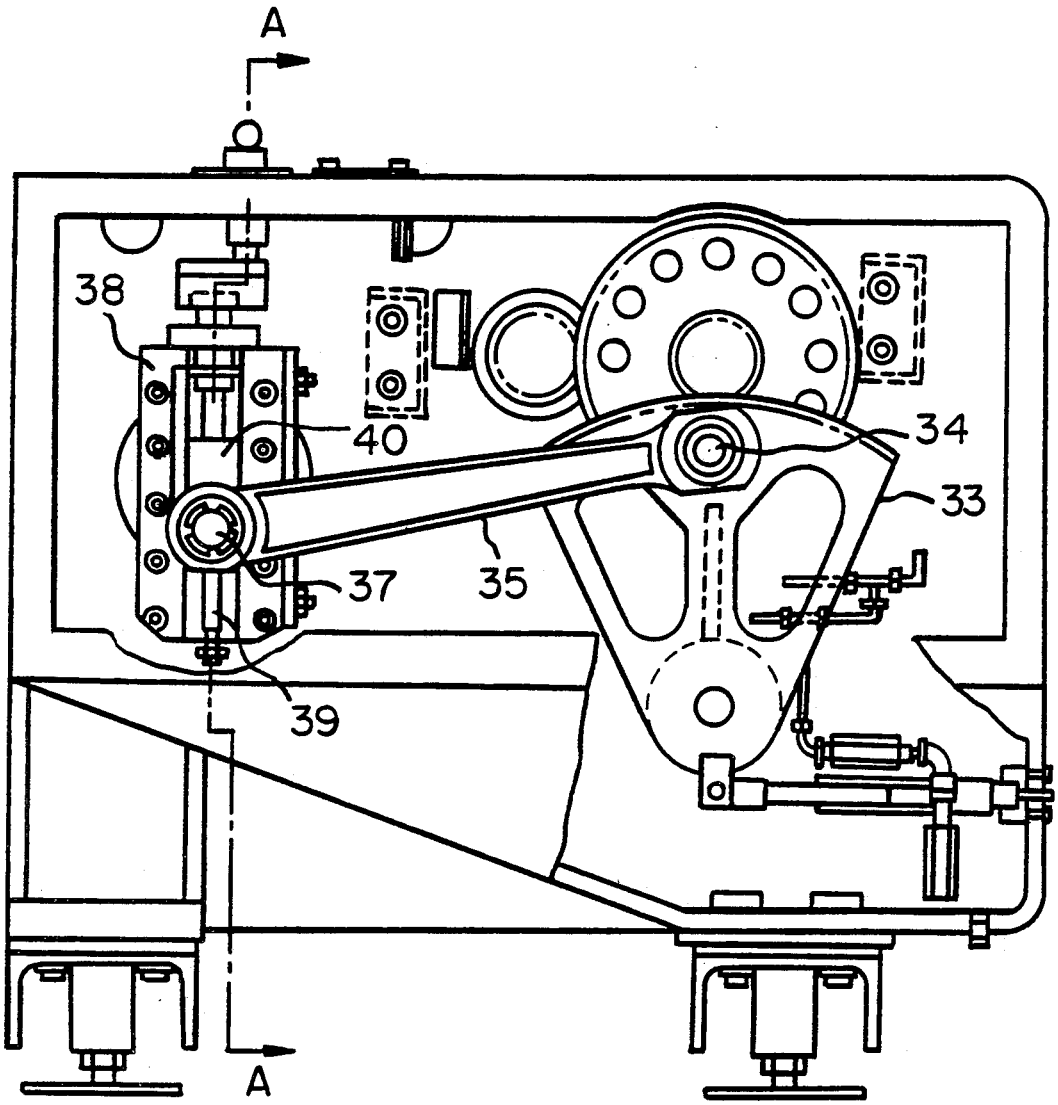
FIG. 3*a* is a front view of a crank.
Figure 3B:
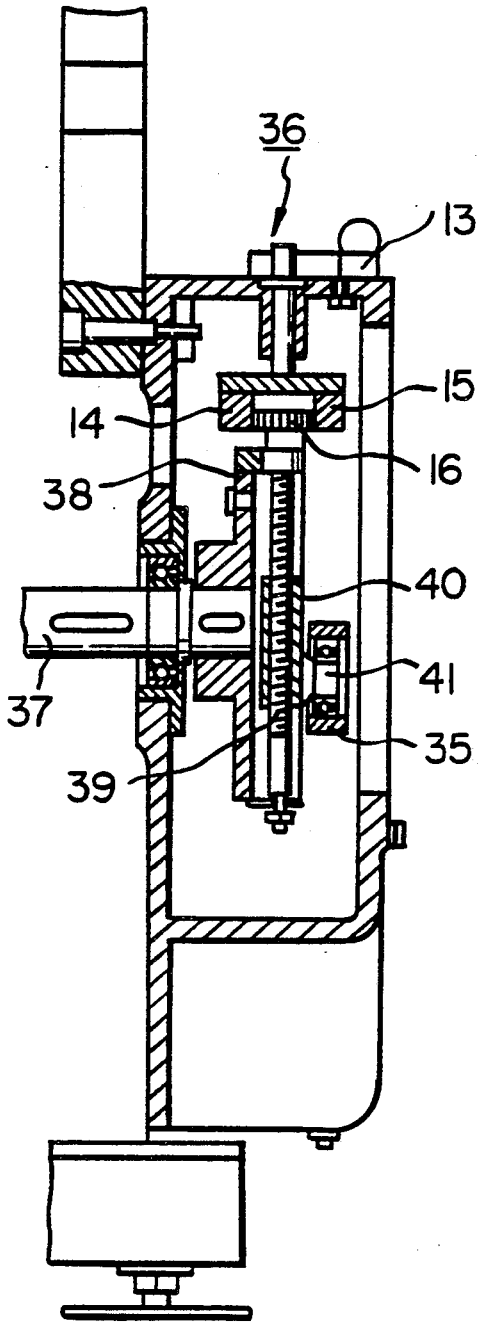
FIG. 3*b* is a cross-sectional view taken along line A-A of FIG. 3*a*.
Figure 4:
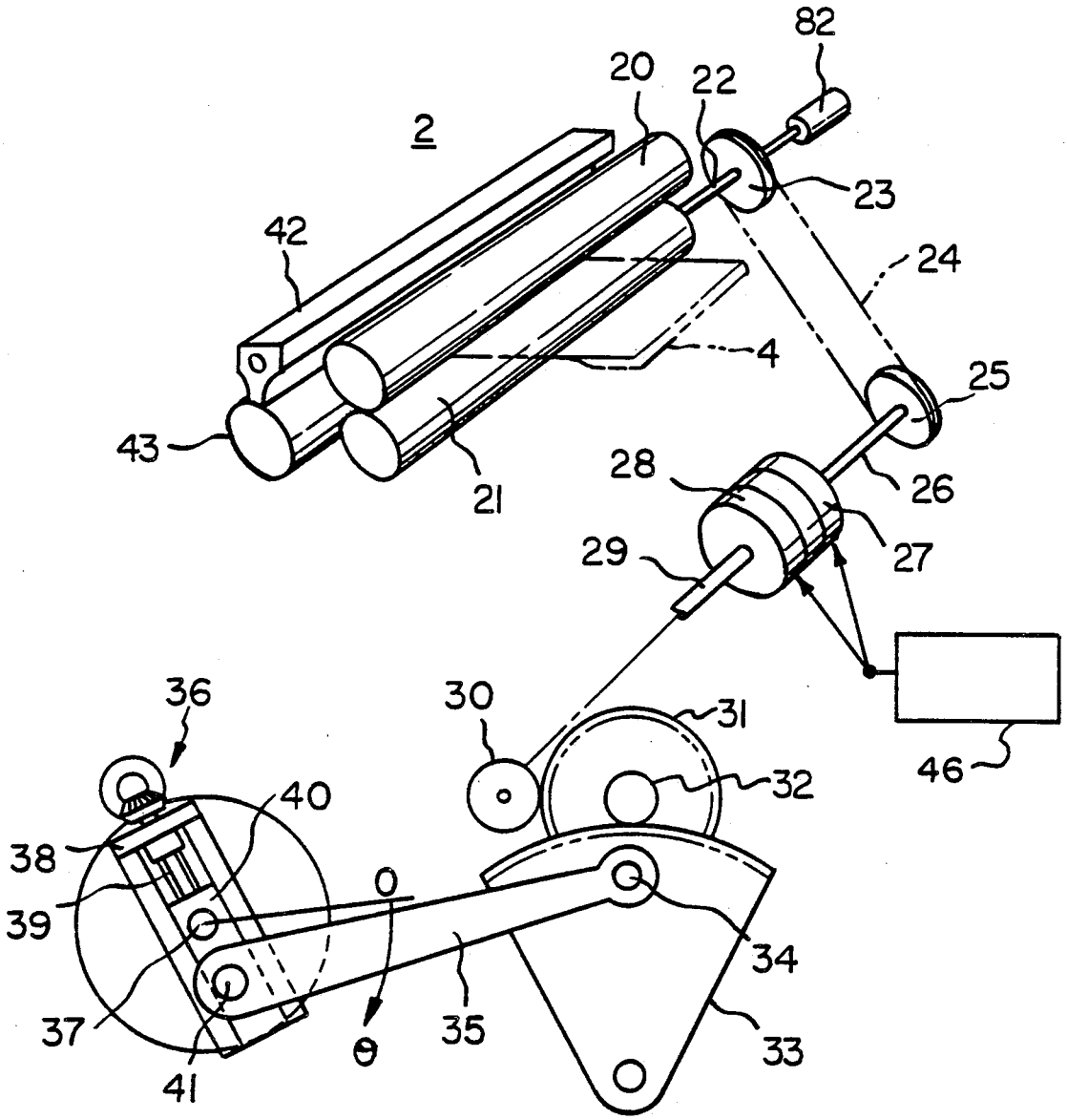
FIG. 4 (PRIOR ART)
FIG. 4 is a perspective view of an intermittent film feeding part of the prior art device of FIG. 2.

As shown in FIG. 1, adding mechanism 48 is provided between drive shaft 37 and screw means 39 for adjusting the eccentric distance of crank 36. The motion of drive 49 controlled by microcomputer 80 is input into adding mechanism 48 and rotates screw 39 to vary the eccentric distance of crank 36 to adjust the length of intermittent feed of film 4.

In adding mechanism 48, sun gear 51 is mounted on the differential shaft 50, and pair of timing pulleys 52, 53 are journaled on shaft 50. Planetary gears 54, 54, . . . . are pivoted on one timing pulley 52 and mesh with the periphery of sun gear 51 and an inner gear provided on another timing pulley 53.

Timing pulley 52 is connected to pulley 55 fixed on drive shaft 37 through timing belt 56.

Timing pulley 53 is connected to screw 39 through timing belt 60, pulley 61, intermediate shaft 62, sprocket wheel 63, chain 64, sprocket wheel 65 journaled on drive shaft 37, gears 66, 67 and bevel gears 68, 69.

Differential shaft 50 of adding mechanism 48 is connected to drive device 49 controlled by microcomputer 80. Namely, differential shaft 50 is connected to shaft 73 of stepping motor 74 through timing belt pulley 70, timing belt 71, and timing belt pulley 72. Shaft 75 of stepping motor 74 is directly connected to encoder 81 for detecting and counting the rotation angle corresponding to the eccentric distance of crank 36.

Signal "a" from encoder 81, signal "b" from encoder 82 for detecting a length of intermittent feeding of the film 4, (i.e. the intermittent rotation angle of shaft 22 of feed rollers 21, 20) and signal "s" for setting the excess distance "d" are input to microcomputer 80. The microcomputer controls stepping motor 74 with output signal "c".

Absolute film feeding length "A" due to the signal "a" from microcomputer 80, actual film feeding length "B" due to the signal "b" and excess distance "d" due to the signal "s" having the following relation:

$$A = B + d.$$

Operation of the device is as follows;

Rotation of drive shaft 37 is transmitted to timing belt pulley 52 of adding mechanism 48 through timing belt pulley 55 and timing belt 56. Rotation of timing belt pulley 53 driven by timing belt pulley 52 through planetary gears 54 is imparted to screw 39 through timing belt 60, pulley 61, intermediate shaft 62, sprocket wheel 63, chain 64, sprocket wheel 65, gears 66, 67, and bevel gears 68, 69. When the pitch of the intermittent feed of film 4 is constant, sprocket wheel 65 and driving shaft 37 integrally rotate at a constant rate and screw 39 does not rotate, and the eccentric distance of crank 36 is constant.

When the pitch of a mark of film 4 varies due to an error in printing or tension on film 4 or stretching of film 4, high speed control unit 46 operates from a signal from photoelectric detector 45 or a signal (not shown) from a timing cam fixed on drive shaft 37 of crank 36. This varies the actual film feeding length "B", and the difference "d" between absolute film feeding length "A" (same as the film feeding length of unprinted film) and "B" offset from the excess distance "d" which is set by input from the keyboard of said microcomputer 80. Namely, in the equation $d = A - B$, "B" varies to "B'" and $d' = A - B'$. Microcomputer 80 transmits a signal "c" to stepping motor 74, and rotates screw 39 to vary the eccentric distance of crank 36 and vary "A" to "A'" and restore the "d'" to "d" (i.e. $d = A' - B'$). Namely, the microcomputer controls the excess distance "d" automatically.

Moreover, when the actual film feed pitch is changed by setting the film feed pitch and automatic adjusting due to an order from microcomputer 80, the rotation angle of feed rollers 20, 21, signal "b" of encoder 82 also changes. Thereby, microcomputer 80 generates output signal "c" corresponding to the variation, and rotates stepping motor 74. When the excess distance "d" against the pitch of a mark is changed to "d'", microcomputer 80 generates an output signal "c" so that "A" to "A''=B+d'" and rotates stepping motor 74. The rotation is transmitted to sun gear 51 of adding mechanism 48 through shafts 75, 73, timing belt pulley 72, timing belt 71, timing belt pulley 70 and differential shaft 50. This rotation is added to the rotation of timing belt pulley 53 and transmitted to screw 39 through timing belt 60, pulley 61, intermediate shaft 62, sprocket wheel 63, chain 64, sprocket wheel 65, gears 66, 67, bevel gears 68, 69. Screw 39 rotates, block 40 moves, the eccentric distance of crank 36 changes, and the rotation angle of sector gear 33 changes according to the change of the feeding pitch of film 4. Namely, in the case of unprinted film, the film feeding pitch changes. In the case of printed film, the feeding of film is corrected against the change in printing so that the excess distance "d" is constant. Moreover, by changing the program in microcomputer 80, error (s) between a basic feeding length of film and actual feeding length of film is within the range O to D, and the basic feeding length of the film is unchanged. If the error (s) is out of the range, the preset excess distance "d'''" may be added or subtracted from the basic feeding length of the film.

As explained above, in said device, microcomputer 80 automatically controls the eccentric distance of crank 36, the excess distance "d" can be constant against the variation in pitch of the print, and the printed mark never escapes from the light spot. Moreover excess distance "d" can be set to a minimum value, so that electromagnetic clutch 28, and electromagnetic brake can be actuated in the vicinity of lower dead point of crank 36. The life of parts increases, noise or vibration of the machine can be reduced, and accuracy of the width and quality of bags is improved.

Figure 5:
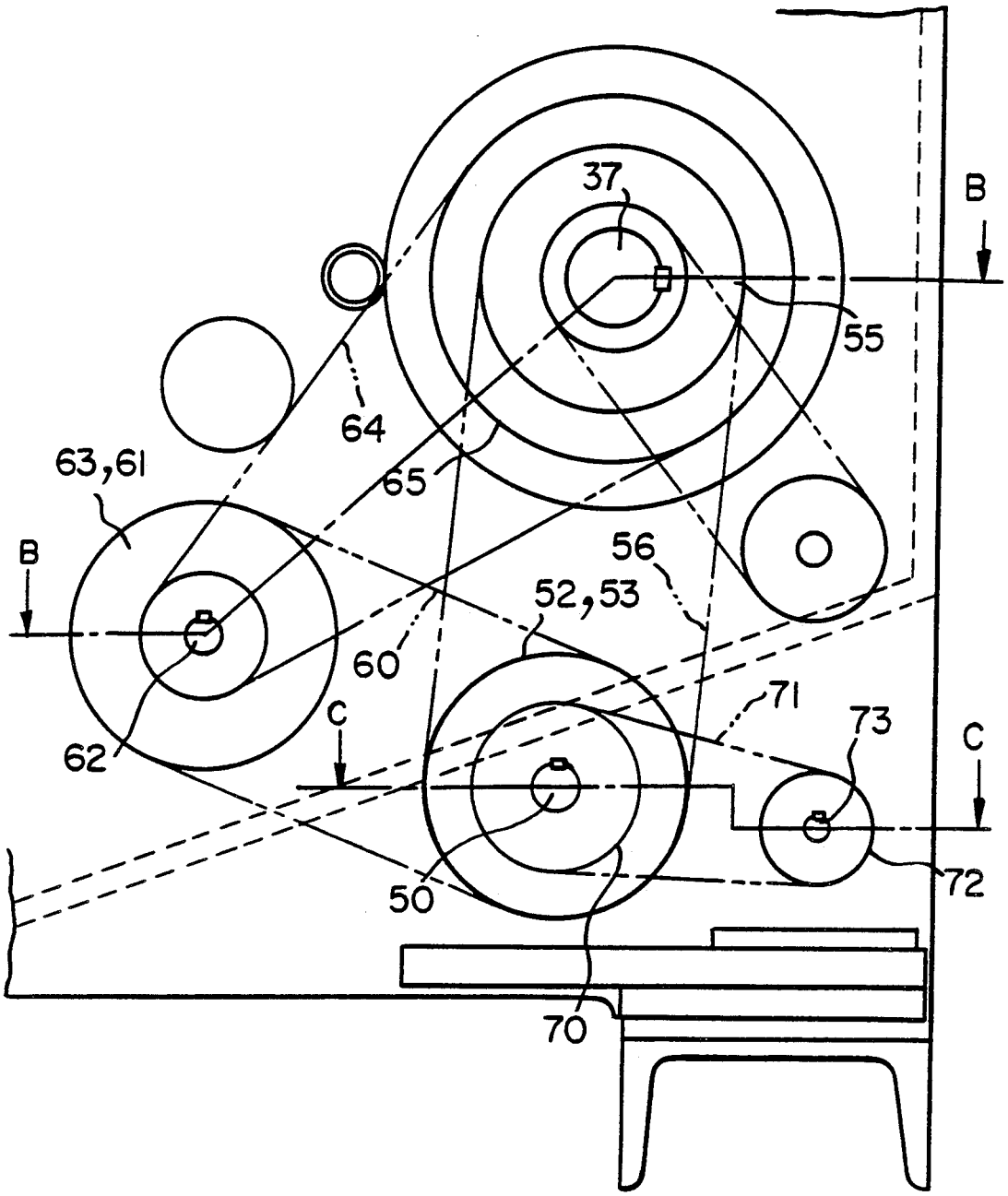
FIG. 5 is a side elevation of one embodiment according to the invention.
Figure 6:
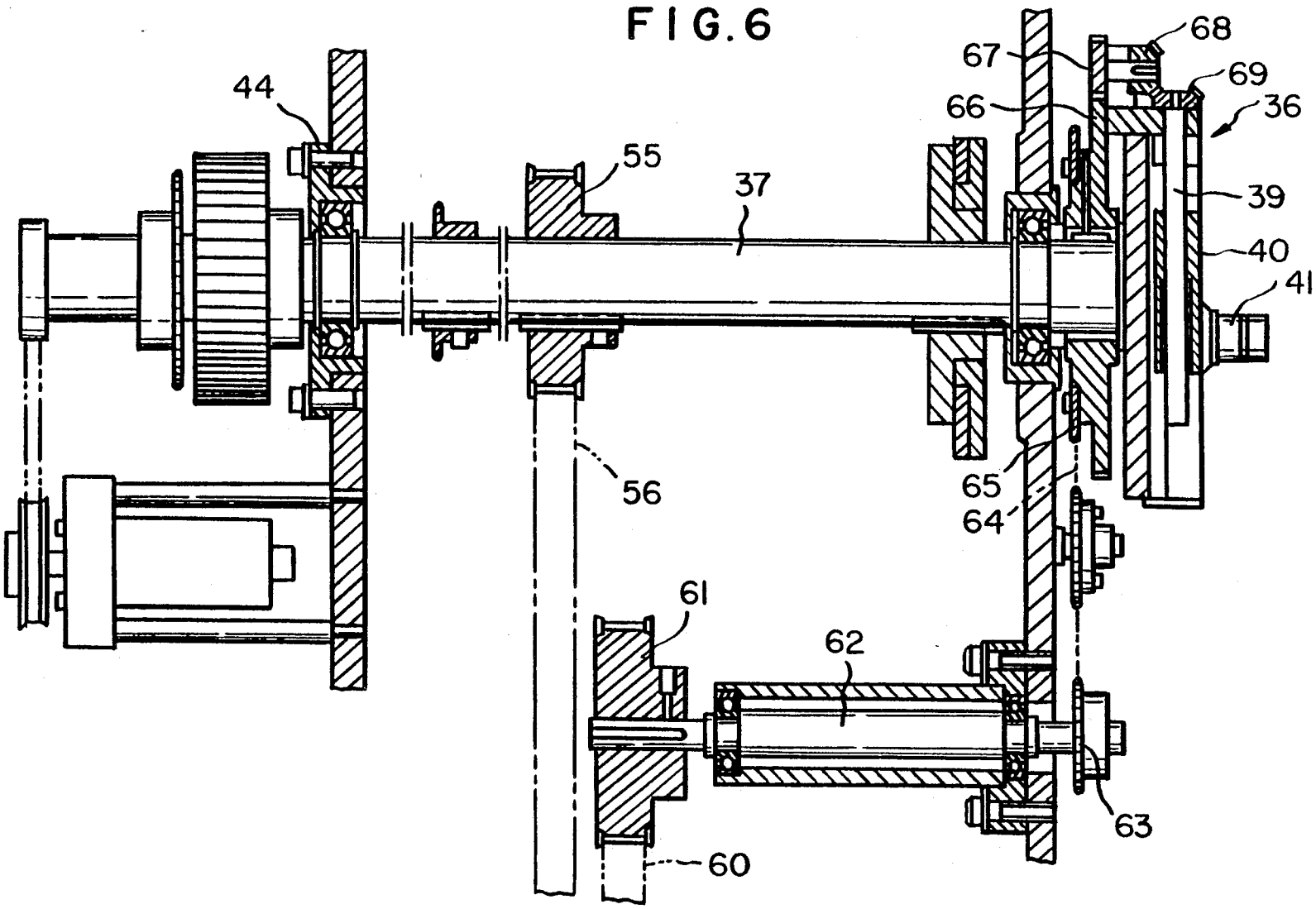
FIG. 6 is a cross-sectional view taken along line B-B of FIG. 5.
Figure 7:
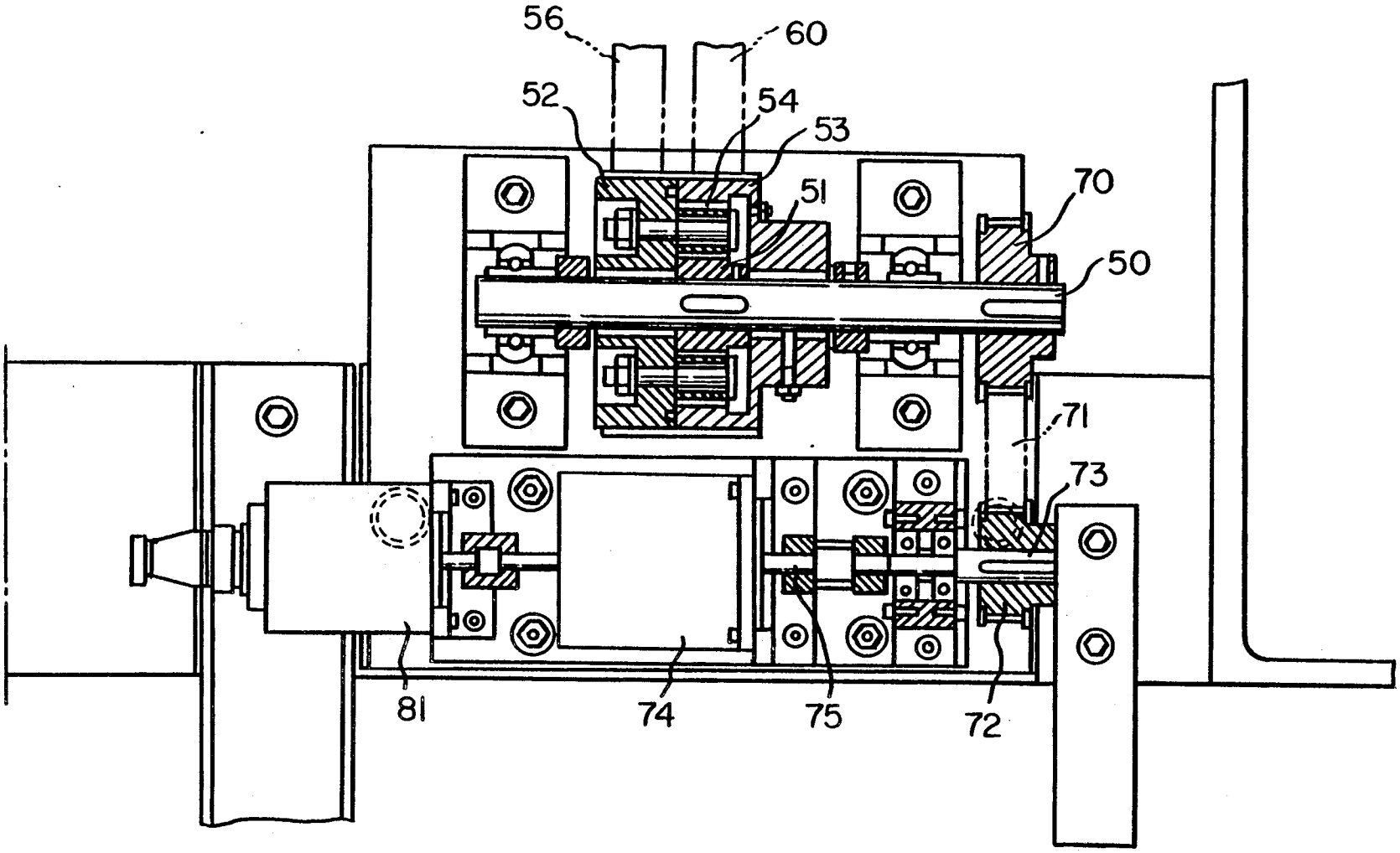
FIG. 7 is a cross-sectional view taken along line C-C of FIG. 5.

FIGS. 5 to 7 shows a specific mechanism for the invention, in which the same numerals are used for the same parts in FIG. 1. In this mechanism, adding mechanism 48 constitutes a timing belt pulley comprising a small and simple planetary gear provided at a remote place from the crank in a driving system.

Therefore, in this invention, the planetary gear, differential gearing of the adding mechanism need not be built in the crank, and can be attached freely so that it can be applied to prior bag manufacturing machines.

That is, the adding mechanism is an additional mechanism to prior machines and a main frame can be common to that of prior machines so that this invention is simple and practical. Moreover, lubrication is required only for the crank part and most of the driving mechanism need not be lubricated.

This invention is not to be limited by the embodiment shown in the drawings and described in the description which is given by way of example and not of limitation, but only in accordance with the scope of the appended claims.

What is claimed is:

1. In an automatic film feeding system having film drive means comprised of intermittently operated film feed rollers, eccentric crank means connected to drive said intermittent feed rollers through an electromagnetic brake and electromagnetic clutch, a drive shaft connected to said crank means, adjusting means for adjusting the eccentricity of said eccentric crank means, photo-electric detecting means for detecting a printed registration mark on said film, a high-speed control unit for controlling operation of said electromagnetic brake and said electromagnetic clutch at high speed in response to a signal (t) from said photo-electric detector means, the improvement comprising; an adding mechanism connected between said drive shaft and said eccentric shaft adjusting means, said adding mechanism including a differential shaft, a timing pulley connecting said differential shaft to said drive shaft, and a sun gear and planetary gears connected through an intermediate drive means to said eccentric crank adjusting means; microcomputer controlled drive means for driving said adding mechanism, said microcomputer controlled drive means including a timing belt pulley connected by a timing belt to said differential shaft of said adding mechanism, and feedback encoder means connected between said stepper motor and said microcomputer to feed back a signal representing the absolute film feeding length; microcomputer means for controlling the motion of said microcomputer controlled drive means; encorder means providing an input signal to said microcomputer means representing intermittent film feed distance; correction signal input means for inputting a correction signal while said film feeding device is running representing the excess offset distance (d) of intermittent film feeding from said printed registration mark; said microcomputer controlled drive means including a stepper motor; said microcomputer means providing an output correction signal to said stepper motor of said microcomputer drive means while said film feed system is in operation in response to a correction signal from said correction signal input means; whereby said microcomputer causes said adding mechanism to automatically adjust said eccentric crank means to correct for excess offset distance of said film input by said encoder means to keep said film feed registration mark within a predetermined range.

* * * * *